United States Patent [19]

Domokos

[11] 4,166,359

[45] Sep. 4, 1979

[54] WATCH BATTERY HATCH CONSTRUCTION

[75] Inventor: Julius Domokos, Fountain Valley, Calif.

[73] Assignee: Hughes Aircraft Company, Culver City, Calif.

[21] Appl. No.: 861,596

[22] Filed: Dec. 19, 1977

[51] Int. Cl.[2] ..... G04B 37/00; G04C 3/00

[52] U.S. Cl. ..... 58/23 BA; 58/88 R

[58] Field of Search ..... 58/23 BA, 88 R, 90 R

[56] References Cited

U.S. PATENT DOCUMENTS

| | | | |
|---|---|---|---|
| 3,672,154 | 6/1972 | Hubner | 58/23 BA |
| 4,009,564 | 3/1977 | Zurcher | 58/23 BA X |
| 4,033,110 | 7/1977 | Sagarino | 58/88 R |
| 4,083,178 | 4/1978 | Sekiguchi et al. | 58/88 R |

*Primary Examiner*—Stanley J. Witkowski

*Attorney, Agent, or Firm*—Allen A. Dicke, Jr.; W. H. MacAllister

[57] ABSTRACT

A hatch cover is positioned in the hatch opening in the watch back over a battery receptacle in the watch module. The hatch cover is mechanically retained in the hatch opening by means of a snap-in friction fit. It has a rim on the watch back. A groove in the back adjacent the rim permits insertion of a tool to snap out the hatch cover. The watch back can remain on the case during battery change to hold the module in the case.

7 Claims, 3 Drawing Figures

WATCH BATTERY HATCH CONSTRUCTION

BACKGROUND OF THE INVENTION

This invention is directed to the construction of a watch case, and particularly the hatch cover and hatch opening construction in the back of a watch having a battery therein.

Some types of modern watches are powered by batteries. These batteries power the primary horological timekeeping element and power the display. Of course, it is necessary to periodically replace the battery in order to keep the watch running.

In some battery powered watches, the entire back is removed. In these watches the back may either be snapped into place or screwed into place. With this arrangement, the watch must be constructed so that when the back is removed, the horological equipment therein is retained in place in the case by another structure. When the back is screwed in place, it is equipped with spanner wrench recesses so that an appropriate spanner wrench can be employed for turning the back. When the back is a snap-in type, then a very narrow groove is presented. A knife or other sharp instrument is engaged in the groove and the back is snapped off.

Similarly, instead of removing the entire back, the back may be equipped with battery hatch openings with battery hatch covers therein. In this way, only the battery hatch cover need be removed to replace the battery, while the watch back stays in place to retain the horological equipment within the watch case. Prior battery hatch covers have been either screwed into place or snapped into place. The screw-type battery hatch covers are equipped with spanner wrench recesses so that by application of an appropriate spanner wrench these battery hatch covers can be removed. The prior snap-in battery hatch covers have been difficult to remove because they present no substantial approach and the opening attempt must be made with a very thin tool.

SUMMARY OF THE INVENTION

In order to aid in the understanding of this invention it can be said in essentially summary form that it is directed to battery hatch construction of a watch. The construction includes a hatch cover held in a hatch opening by mechanical fit. The hatch cover has a flange external to the watch back and the watch back has a slot adjacent the flange so that the slot and flange can receive a tool therebetween for prying off the battery hatch cover.

It is thus an object of this invention to provide a battery hatch construction for a watch whereby the battery hatch cover may be readily and easily opened for the replacement of batteries within the watch.

It is another object to provide a battery hatch construction wherein the hatch cover is snapped into place and is retained in place by means of a mechanical fit, either by friction fit of metal-to-metal contact or by seal engagement or by means of a snap-in nose which passes into a larger space and expands therein to positively hold the back in place.

It is a further object to provide a battery hatch construction for a watch wherein the user can remove the battery hatch cover with a convenient tool without the need for the attention of a watch repair professional, so that the user can replace the battery.

It is a further object to provide an inexpensive but reliable watch battery hatch construction wherein the battery hatch cover can be easily removed and replaced and in which the battery hatch cover will reliably seal the battery hatch.

Other objects and advantages of this invention will become apparent from a study of the following portion of the specification, the claims and the attached drawings.

DESCRIPTION OF THE PREFERRED EMBODIMENT

Figure 3:
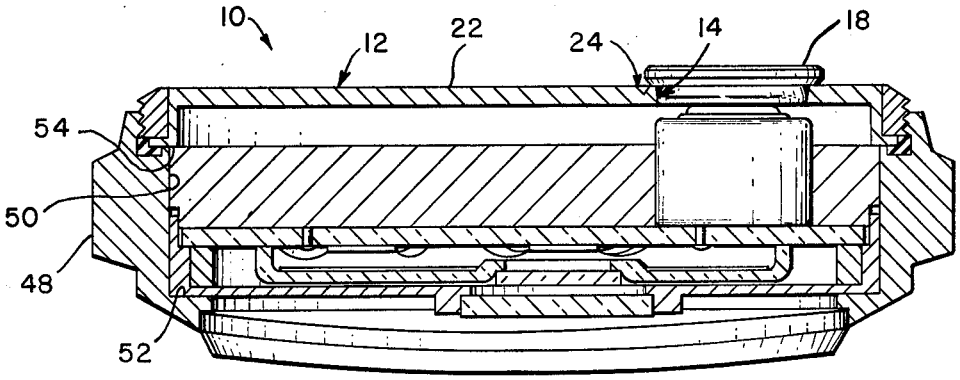
FIG. 3 is an enlarged section taken generally along line 3—3 of FIG. 1, showing details of the watch module in the case and the manner in which the watch back holds the module in the case.

Watch 10 has a case 48 and the case has watch back 12 fitted thereto. The case contains the horological equipment of a watch which is powered by one or more electric batteries. The watch display is usually at the front of the watch case, as seen in FIG. 3, opposite to the back. The watch batteries lose their charge by operating the watch. When the batteries are nearly or completely discharged, they must be replaced in order to maintain timekeeping by the watch.

In accordance with this invention, access to the batteries for the replacement is through two hatch openings in the watch back which are positioned over the batteries and are covered by hatch covers. One of the hatch openings is shown at 14 and the two hatch covers for the two hatch openings are shown at 16 and 18.

Hatch opening 14 is an opening in watch back 12. Preferably it is tapered to provide tapered surface 20 which is largest at the rear surface 22 of watch back 12.

Figure 1:
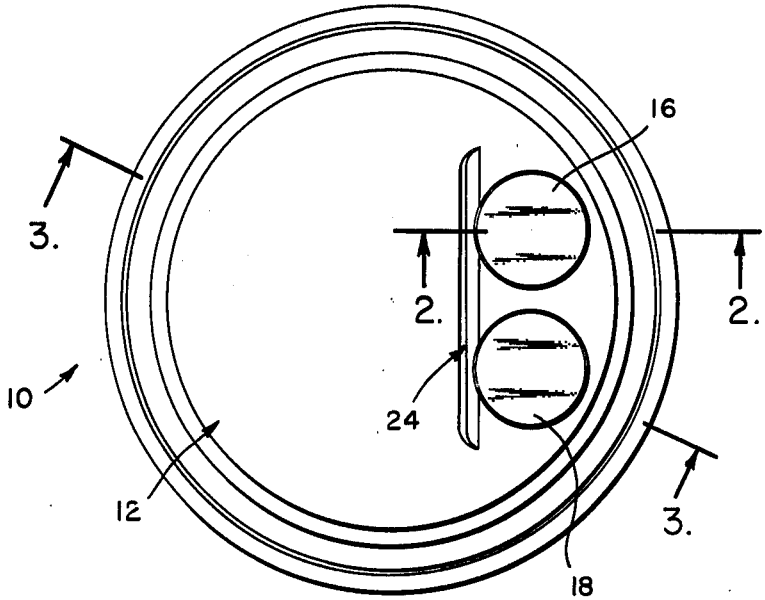
FIG. 1 is a plan view of the back of a watch having the watch battery hatch construction of this invention.
Figure 2:
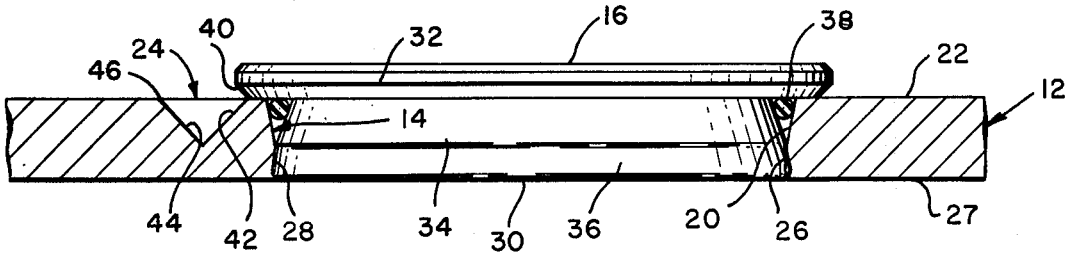
FIG. 2 is an enlarged section taken generally along line 2—2 of FIG. 1.

Recess 24 is formed into watch back 12 to extend below surface 22. Recess 24 is adjacent the hatch covers as is seen in FIG. 1 and is adjacent hatch opening 14 as is seen in FIGS. 2 and 3. One recess 24 is shown in connection with both hatch openings. The use of a single long recess 24 as shown in FIG. 1 is considered as being of better appearance than two separate recesses, one adjacent each hatch opening. However, a separate recess in conjunction with each hatch opening is also feasible. The particular shape of recess 24 will be described below.

Tapered surface 20 joins surface 26 toward the inside surface 27 of the watch back. Surface 26 starts about two-thirds the way from the rear surface to the inside surface of the watch back. Surface 26 may be cylindrical with rounded junctures at tapered surface 20 and the inside surface 27 of the watch back, may be rounded between those two surfaces or may be slightly tapered in the direction which is larger toward the inside surface 27 of the watch back. The smallest diameter opening 28 of hatch 14 is critical with respect to the fit of hatch cover 16 therein.

Hatch cover 16 has a plug 30 and flange 32. Plug 30 has an outwardly tapered surface 34 which increases in diameter from flange 32 toward nose surface 36. Nose surface 36 is rounded and represents the largest diameter of the nose. The angle of conically tapered surface 20 and of conically tapered surface 34 is such as to permit the positioning of seal ring 38 therebetween. Seal ring 38 is conveniently a rubber-like elastomeric O-ring. The compression of the seal ring between the conically tapered surfaces and the underside of flange 32 toward surface 22 compresses the seal ring to provide the necessary degree of sealing.

Flange 32 has rim surface 40 which lies at substantially right angles to bottom surface 42 and substantially parallel to pry surface 44 of recess 24. Flange 32 partially overlies recess 24 so that surfaces 40 and 42 substantially lie together at a right angle.

The diameter of nose surface 36 is larger than the diameter of the smallest diameter opening 28 of the hatch opening. Furthermore, the diameter of nose 36 is at least as small as and is preferably smaller than the largest diameter of tapered surface 20, where the tapered surface joins rear surface 22. The amount that the diameter of nose surface 36 is larger than the smallest diameter opening 28 is such that resilient deflection can occur to permit the hatch cover to snap into and snap out of the hatch without permanent bending or scoring. In order to aid deflection, plug 30 of hatch cover 16 can be hollow or open backed to the level of flange 32. Hatch cover 16 can be placed with its nose 36 in the hatch opening and against tapered surface 20. Thereupon, it is manually pressed into place, the fits and deflections being such that manual force can accomplish this insertion. After insertion, the compression of seal ring 38 between the surfaces provides the sealing function. When it is desired that the hatch cover be removed, a simple blunt tool can be inserted into recess 24 and pryed around the fulcrum corner 46 at the juncture of pry surface 44 and rear surface 22. This lifts flange 32 away from the rear surface and pops the hatch cover out of the hatch. Recess 24 is preferably of such dimensions that a thin coin can be employed as the blunt tool. In this way, the user can reach and remove the watch batteries, can insert new batteries and replace the hatch covers.

FIG. 3 shows a section through watch case 48. Module 50 is positioned within case 48 and abuts against shoulder 52 therein. Watch back 12 has shoulder 54 thereon which abuts against the back of module 50. Thus, module 50 is retained in case 48 by being clamped between shoulder 52 in the case and shoulder 54 on the watch back. The watch back may be retained in the case by any convenient, conventional means. It can be screwed into place, snapped into place, or may be retained by the construction shown which is by employment of a clamp ring screwed into the case and clamping the back onto the case. That kind of construction permits the back to be assembled at any angular orientation so that the hatch opening and the hatch covers 16 and 18 can be positioned over the batteries in module 50. By this construction, the module is retained in position, clamped in the case when the batteries are changed. For more details as to this case construction, see Ho et al U.S. Pat. No. 3,846,971, the entire disclosure of which is incorporated herein by this reference.

This invention having been described in its preferred embodiment it is clear that it is susceptible to numerous modifications and embodiments within the ability of those skilled in the art and without the exercise of the inventive faculty. Accordingly, the scope of this invention is defined by the scope of the following claims.

What is claimed is:

1. A watch back for a watch having a battery receiving recess therein, said watch back having a rear surface, having a circular hatch opening therein over said battery receiving recess and having a circular hatch cover for covering said hatch opening and said battery receiving recess;

walls defining a recess in said watch back adjacent said hatch opening;

said circular hatch opening in said watch back being larger in diameter adjacent said rear surface of said watch back than away from said rear surface of said watch back so that said hatch opening is tapered to ease insertion of said hatch cover;

said hatch cover being positionable in said hatch opening and being retained therein by a friction fit, said hatch cover having a flange thereon, said flange lying against said rear surface of said watch back and extending around said hatch opening, said recess being positioned closely adjacent said hatch opening so that said hatch cover flange partially overlies said recess so that a tool can be inserted into said recess and engaged under said flange to snap said hatch cover out of said hatch opening.

2. The watch back of claim 1 wherein said hatch cover has a plug thereon and a seal ring is positioned between said plug in said hatch opening beneath said flange to seal said plug in said opening.

3. The watch back of claim 1 wherein said recess has a bottom surface and a pry surface, said bottom surface and said pry surface intersecting each other, said bottom surface also intersecting the rear surface of said back under said flange of said hatch cover and said pry surface intersecting said rear surface of said back away from said flange so that a tool can be engaged against said pry surface and under said flange to snap said hatch cover out of said hatch opening.

4. A watch comprising:

a case, a recess in said case, a shoulder in said case defining the front of said recess;

a watch module in said case engaged against said shoulder in said case, said module being arranged to receive a battery at a battery position;

a back on said case, said back having a shoulder thereon, said shoulder on said back engaging against said module to retain said module against said shoulder in said recess;

a rear surface on said watch back, a hatch opening in said rear surface, through said watch back said hatch opening overlying said battery position, walls defining a recess in said watch back adjacent said hatch opening; and a hatch cover being positionable in said hatch opening and being retained therein by a friction fit to cover said hatch opening and said battery position, said hatch cover having a flange thereon, said flange lying against said rear surface of said watch back and extending around said hatch opening, said recess being positioned closely adjacent said hatch opening so that said hatch cover flange partially overlies said recess so that a tool can be inserted into said recess and engage under said flange to snap said hatch cover out of said hatch opening so as to permit access to said battery position.

5. The watch of claim 4 wherein said hatch opening in said watch back is circular and said hatch cover is circular.

6. The watch of claim 5 wherein said hatch opening in said watch back is larger in diameter adjacent said rear surface of said watch back than away from said rear surface so that said hatch opening is tapered to ease insertion of said hatch cover into said hatch opening.

7. The watch of claim 4 wherein said hatch cover has a ply thereon and a seal ring is positioned between said plug in said hatch opening beneath said flange to seal said plug in said opening.

* * * * *